US006712628B2

(12) United States Patent
Villain et al.

(10) Patent No.: US 6,712,628 B2
(45) Date of Patent: Mar. 30, 2004

(54) CONNECTOR/SWITCH UNIT FOR A FLAT ANTENNA

(75) Inventors: Jean-Christophe Villain, Colombes (FR); Bertrand Cupif, Antony (FR); Frédéric Vogel, Asnieres sur Seine (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 10/436,258

(22) Filed: May 13, 2003

(65) Prior Publication Data

US 2003/0232531 A1 Dec. 18, 2003

(30) Foreign Application Priority Data

Jun. 13, 2002 (FR) ..... 02 07272

(51) Int. Cl.[7] ..... H01R 29/00
(52) U.S. Cl. ..... 439/188; 439/944
(58) Field of Search ..... 439/188, 63, 74, 439/944

(56) References Cited

U.S. PATENT DOCUMENTS 6,224,407 B1 * 5/2001 Duquerroy et al. ..... 439/188
6,473,045 B1 * 10/2002 Duquerroy et al. ..... 439/188
6,520,785 B2 * 2/2003 Hida ..... 439/188

FOREIGN PATENT DOCUMENTS

| | | |
|---|---|---|
| EP | 1 041 680 A2 | 10/2000 |
| EP | 1 187 267 A2 | 3/2002 |
| GB | 2 307 113 A | 5/1997 |

* cited by examiner

*Primary Examiner*—Tho D. Ta
(74) *Attorney, Agent, or Firm*—Sughrue Mion, PLLC

(57) ABSTRACT

The invention concerns the devices which make it possible to connect a plug (116) to a radio frequency circuit (207) whilst simultaneously breaking the connection from this radio frequency circuit to an antenna circuit (201). It consists in using the ends of the earth plane (203) and of the antenna circuit (201) in order to directly establish respectively contact between the external casing (116) of the plug with the earth plane (203) when the plug is connected, and contact between a spring connector (204) itself connected to the radio frequency circuit (207) and the antenna circuit (201) when the plug is disconnected. This spring connector (204) is held captive in a cylindrical protrusion (213) on the support (202) for the antenna circuit and the earth plane.

4 Claims, 2 Drawing Sheets

CONNECTOR/SWITCH UNIT FOR A FLAT ANTENNA

The present invention relates to devices which combine both a connector and a switch for disconnecting an "antenna circuit", in particular of the "patch antenna" type hereinafter referred to as a flat antenna, and circuits for supplying this, whilst connecting these same circuits to a plug allowing external connection of these circuits. This plug is for example itself connected to a cable for supplying an antenna which is more effective than the initial flat antenna. Such devices are for example used for connecting a portable telephone to a fixed base.

Figure 1:
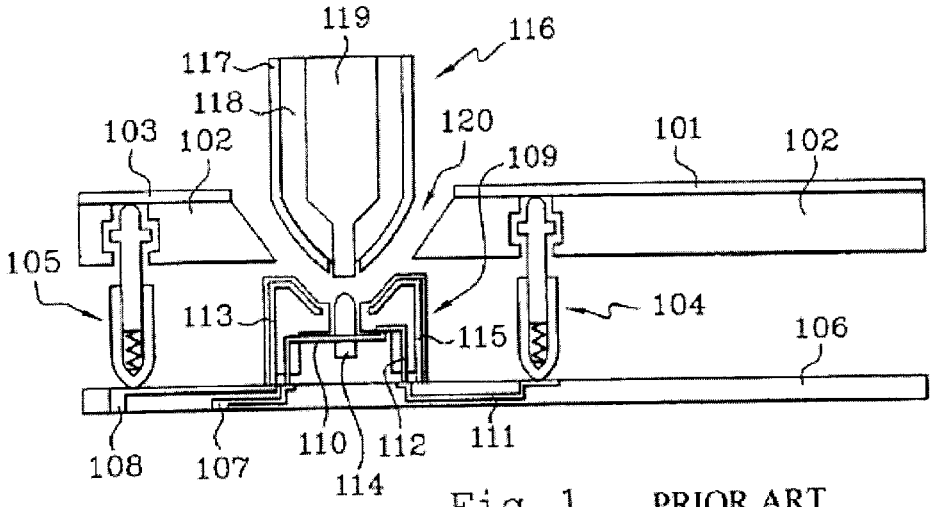
Fig. 1 PRIOR ART
Figure 2:
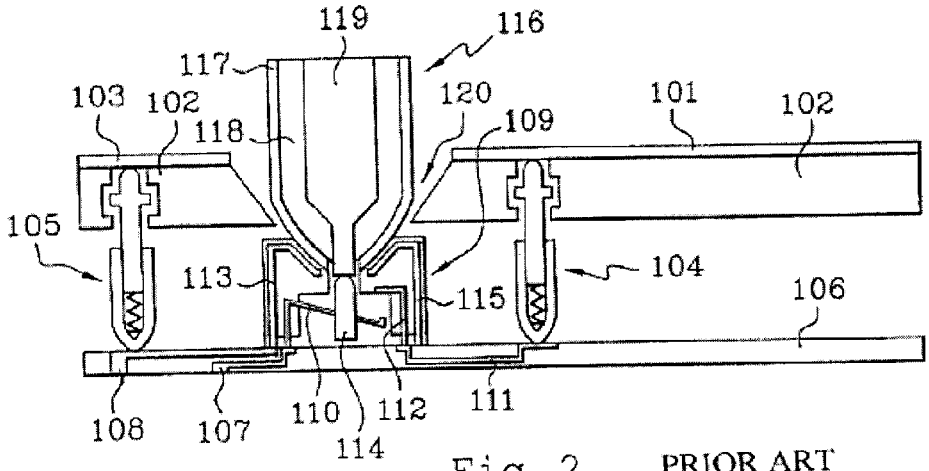
Fig. 2 PRIOR ART

Such a currently known device is depicted in its disconnected state in FIG. 1 and in its connected state in FIG. 2.

The flat antenna 101 is fixed to a support 102, as is the earth plane 103 which supplements the antenna in order to obtain the required radiation diagram. The antenna is supplied by a spring connector 104 and the earth plane by a spring connector 105, from circuits for transmitting and/or receiving radio frequency signals which are themselves fixed to a printed circuit board 106.

The radio frequency signal arrives at this printed circuit through a circuit 107 and the earth through a circuit 108. The radio frequency signal is then routed from this circuit 107 as far as a spring connector 104 by means of a switch 109 formed by a spring blade 110 which can, according to its position, provide continuity between the circuit 107 and a circuit 111 on which the spring connector 104 bears.

The continuity between the blade 110 and the circuit 111 is provided by a conductive piece 112 fixed in the insulating body 113 of the switch. A metallic rod 114 perpendicular to the plane of the circuit 106 is fixed to the flexible blade 110.

When a pressure is exerted on the end of this rod, it makes the blade 110 flex and cuts off communication between this blade and the piece 112. The body 113 is itself surrounded by a conductive pot 115 which is connected to the earth circuit 118 in order to be able to obtain the earth recovery as described below.

In the disconnected state illustrated in FIG. 1, the radio frequency signal arrives through the conductor 107, passes through the blade 110, the piece 112, the conductor 111 and the spring connector 104, and is finally applied to the flat antenna 101.

In order to be able to use an external antenna, or possibly a measuring circuit, a plug 116 is used, comprising an external casing 117 and a central conductor 119 forming a core and separated from the conductive external casing by an insulating layer 118.

This plug is conical in shape, so as to be able to enter a hole 120 provided in the support 102 in line with the switch 109 and situated also at the separation level between the flat antenna 101 and the earth plate 103. The end of the central conductor 119 of the plug 116 projects at the tip of this conical part at a hole provided in the external casing 117.

When the plug is lowered in order to insert it in the hole 120, the end of the core 119 presses on the rod 114, which makes the blade 116 flex and interrupts the transmission of the radio frequency signal to the piece 112 and therefore to the flat antenna 101. The radio frequency signal is on the other hand then applied to the core 119 of the plug, so as to be able to be transmitted to the circuits connected to this plug, which are not shown in the figure.

Simultaneously, the conical part of the casing 117 of the plug is placed in a hollow provided in the top part of the conductive pot 115 of the switch 119 and adapted to the conical shape of the end of the plug. In this way contact is established between the casing 117 of the plug and the pot 115 of the switch, which establishes the earth connection between the circuit 108 and the external casing of the plug.

Mechanical means, not shown but known to persons skilled in the art, provide the mechanical fixing of these pieces together.

This system functions well but has the drawback of being of large size and consequently reducing the surface area of the flat antenna, which therefore reduces the performance of the latter.

In order to be able to reduce the dimensions of this system and to be able to increase the surface area and therefore the efficacy of the flat antenna, the invention proposes a connector/switch unit for alternately connecting an earth circuit respectively to an earth plane or to the external casing of a plug, and a radio frequency circuit respectively to an antenna circuit or to the core of said plug, this earth plane and antenna circuit being carried by one and the same insulating support plane comprising a hole for allowing said plug to pass, principally characterized in that the earth circuit is connected to said earth plane by a first spring connector distinct from the switching means of the unit, in that the support plane comprises a hollow cylindrical protrusion comprising an internal cavity opening out in said hole, in that this hole comprises an oval hollow periphery adapted to the conical shape of said plug, in that the antenna circuit and the earth plane are extended towards the inside of the hole whilst matching said oval hollow periphery, and in that the unit also comprises a second spring connector placed in the said internal cavity and comprising a central rod provided with a collar and pushed in one direction by a spring in order to establish contact with the antenna circuit when said plug is removed, and to establish contact with said core by cutting off contact with the antenna circuit when said plug is pressed into the hole, pushing said rod in the other direction.

According to another characteristic, the unit comprises a printed circuit board coplanar with said flat support supporting said earth circuit and said radio frequency circuit; said cylindrical protrusion bearing on the printed circuit board and the second spring connector also bearing on the printed circuit plate at the radio frequency circuit through its end opposite to the one establishing contact with the plug.

According to another characteristic, the extension of the antenna circuit inside the hole is sufficiently long to serve as a stop for the said central rod by means of the collar carried by this central rod.

Figure 3:
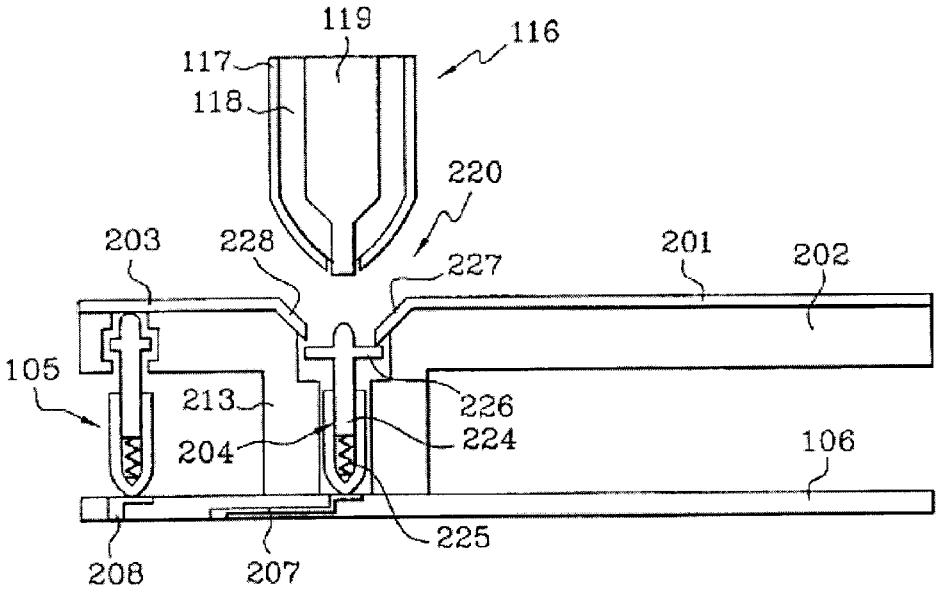
Figure 4:
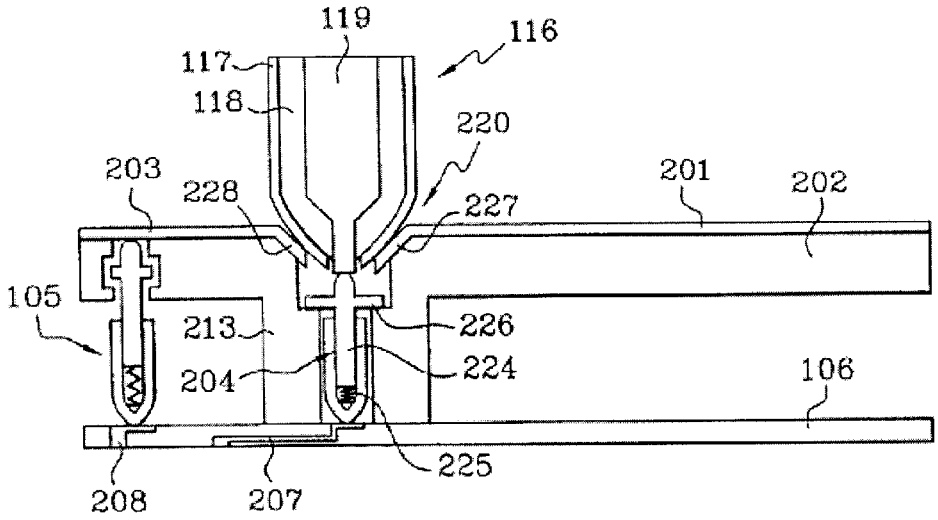

Other particularities and advantages of the invention will emerge clearly from the following description, given with regard to the accompanying figures, which depict:

FIGS. 1 and 2, views in section of a known device, in two states, respectively not connected and connected; and FIGS. 3 and 4, views in section of a device according to the invention, in the same non-connected and connected states.

The device according to the invention, depicted schematically and in section in FIGS. 3 and 4, also comprises a flat antenna 201 and an earth plane 203 both fixed to a support 202, and a printed circuit board 106 which comprises a radio frequency signal circuit 207 and an earth circuit 208.

The plug 116 intended to be connected to this device is identical to the one in FIGS. 1 and 2.

The earth circuit 208 is connected to the earth plane 203 by means of a spring connector 105, in the same way as in FIG. 1. However, this circuit 208 is connected only to the spring connector 105.

The support 202 comprises a protrusion 213 in the form of a cylinder perpendicular to the plane of this support, the printed circuit board 106, the antenna and the earth plane. This protrusion is hollow and its axis is merged with that of the plug 116 in the position in which the latter is connected to the device.

The internal cavity of the cylinder 213 contains a second spring contactor 204 whose base is in direct contact with the circuit 207 receiving the radio frequency signal.

The top end of the internal cavity of the cylinder 213 opens out on the surface of the support 202, forming a conical cavity 220.

The conductive sheet forming the flat antenna 201 is dished to the shape of this conical cavity 220 in order to open out inside the internal cylindrical cavity of the cylinder 213.

In the same way, the metallic sheet composing the earth plane 203 is dished in the form of the conical cavity 220 in order to open out in this internal cylindrical cavity of the cylinder 213.

The lengths of the parts 227 of the flat antenna on the one hand and 228 of the earth plane on the other hand, which open out in this interior, are such that the end of the flat antenna is situated closer to the printed circuit 106 than is the end of the earth plane.

The spring contact 204 comprises, in a known manner, a movable rod 224 which is pushed upwards by a spring 225. This rod comprises at its top end, a little lower than the latter, a collar 226 which is wider than the space existing between the ends 227 and 228 respectively of the flat antenna and of the earth plane which open out in the internal cavity of the protrusion 213.

In this way, under the thrust of the spring 225, the rod 224 makes contact with the flat antenna 201 without making contact with the earth plane 203, because of the different dimensions, explained above, of the ends of these two members.

In the non-connected case depicted in FIG. 3, the flat antenna 201 is therefore supplied by the spring connector 204 from the circuit 207, and the earth plane 203 is connected to the earth circuit 208 by means of the spring connector 105.

By making the plug 116 descend in the oval hole 220, as depicted in FIG. 4, the end of the core 119 of the plug 116 will bear on the end of the rod 224, which pushes it downwards, compressing the spring 225. This action causes on the one hand the disconnection of the flat antenna 201 from the rod 224 and therefore from the radio frequency supply circuit 207, and the connection of this rod 224 to the core 119 of the plug 116. This plug is therefore supplied with the radio frequency signal applied to the circuit 207, by means of the spring connector 204.

When the plug is fully inserted in the oval hole 220, it is locked in position, connected by mechanical means such as those cited above, and earth contact is then established between the earth plane 203 and the external casing 117 of the plug by means of the part 228 of the earth plane.

In addition, the flat antenna 201 is itself connected to the external casing 117 by means of its part 227. It can be seen that, in this connected position, the flat antenna forms with the earth plane a single earth plane, enlarged and substantially continuous, which improves the performance of the whole all the more.

In addition, in accordance with the principal aim of the invention, the oval hole 220 is much smaller than the oval hole 120 of the prior art, which increases the dimensions of the flat antenna and therefore its efficacy.

Finally, all the components participating in the connection and disconnection are much smaller in number, which increases the simplicity and therefore the reliability of the whole whilst reducing the production cost.

What is claimed is:

1. A connector/switch unit for alternately connecting an earth circuit (208) respectively to an earth plane (203) or to the external casing (117) of a plug (116), and a radio frequency circuit (207) respectively to a antenna circuit (201) or to the core (119) of the said plug, this earth plane and antenna circuit being carried by one and the same insulating support plane (202) comprising a hole (220) for allowing said plug (116) to pass, wherein:

the earth circuit (208) is connected to the said earth plane (203) by a first spring connector (105) distinct from the switching means of the unit, the support plane comprises a hollow cylindrical protrusion (213) comprising an internal cavity opening out in said hole (220), said hole comprises an oval hollow periphery adapted to the conical shape of said plug (116), the antenna circuit and the earth plane are extended towards the inside of the hole whilst matching said oval hollow periphery, the unit also comprises a second spring connector (204) placed in said internal cavity and comprising a central rod (224) provided with a collar and pushed in one direction by a spring element (225) in order to establish contact with the antenna circuit when said plug is removed, and to establish contact with said core by cutting off contact with the antenna circuit when said plug is pressed into the hole, pushing said rod in the other direction.

2. A unit according to claim 1, comprising a printed circuit board (106) coplanar with said support plane (202) supporting said earth circuit (208) and said radio frequency circuit (207); said cylindrical protrusion (213) bearing on the printed circuit board (106) and the second spring connector (204) also bearing on the printed circuit board (106) at the radio frequency circuit (207) through its end opposite to the one establishing contact with the plug (116).

3. A unit according to claim 1, wherein the extension (227) of the antenna circuit inside the hole (220) is sufficiently long to serve as a stop for the said central rod (224) by means of the collar (226) carried by this central rod.

4. A unit according to claim 1, wherein the antenna circuit is of the "patch antenna" type, referred to as a flat antenna.

* * * * *